US006608429B1

(12) United States Patent
Snyder

(10) Patent No.: US 6,608,429 B1
(45) Date of Patent: Aug. 19, 2003

(54) X-RAY IMAGING SYSTEM WITH CONVECTIVE HEAT TRANSFER DEVICE

(75) Inventor: Douglas J. Snyder, Brookfield, WI (US)

(73) Assignee: GE Medical Systems Global Technology Co., LLC, Waukesha, WI (US)

( * ) Notice: Subject to any disclaimer, the term of this patent is extended or adjusted under 35 U.S.C. 154(b) by 274 days.

(21) Appl. No.: 09/639,537

(22) Filed: Aug. 16, 2000

(51) Int. Cl.[7] ..... H01J 35/10

(52) U.S. Cl. ..... 313/36; 313/44; 313/46; 378/140; 378/141; 378/142; 378/130

(58) Field of Search ..... 313/36, 35, 30, 313/42–46, 11; 378/140, 141, 142, 199, 200, 136, 121–127, 130; 250/370.09

(56) References Cited

U.S. PATENT DOCUMENTS 4,058,160 A * 11/1977 Corman et al. ..... 165/104.26
4,071,768 A * 1/1978 Goodenough ..... 378/125
4,165,472 A * 8/1979 Wittry ..... 313/30
4,683,940 A * 8/1987 Ernst et al. ..... 165/104.26
4,768,212 A * 8/1988 Appelt et al. ..... 313/36
5,486,703 A * 1/1996 Lovin et al. ..... 250/492.3
6,170,809 B1 * 1/2001 Cotter ..... 267/119
6,263,046 B1 * 7/2001 Rogers ..... 378/140
6,361,208 B1 * 3/2002 Takenaka et al. ..... 378/199

* cited by examiner

*Primary Examiner*—Nimeshkumar D. Patel
*Assistant Examiner*—Sikha Roy
(74) *Attorney, Agent, or Firm*—Peter J. Vogel

(57) ABSTRACT

Passive heat transfer apparatus is provided for an X-ray imaging system used in connection with mammaography, to rapidly conduct heat away from the system X-ray tube. The apparatus comprises a thermally conductive support plate located in the tube housing, in spaced apart relationship with the X-ray tube, and further comprises an elongated device for transferring heat by convection, such as a heat pipe. The heat transfer device has a first end joined to the tube, and a second end joined to the support plate. A quantity of selected working fluid sealably contained in the heat transfer device is disposed to transfer heat along the length thereof, from the tube to the support plate, and cooling fins extending through the housing from the support plate dissipate the heat into the surrounding environment. A layer of sound absorbing material is usefully positioned to surround the X-ray tube within the housing, to provide acoustic damping and substantially reduce the level of noise resulting from X-ray tube operation.

21 Claims, 3 Drawing Sheets

X-RAY IMAGING SYSTEM WITH CONVECTIVE HEAT TRANSFER DEVICE

BACKGROUND OF THE INVENTION

The invention disclosed and claimed herein generally pertains to passive heat transfer apparatus for an X-ray imaging system having a rotating anode X-ray tube, wherein the heat transfer apparatus is disposed to conduct heat away from regions proximate to the tube. More particularly, the invention pertains to apparatus of the above type wherein the head of an imaging subject is typically positioned so that noises generated proximate to an X-ray tube are particularly disturbing. Even more particularly, the invention pertains to apparatus of the above type which is very useful in connection with X-ray systems used for mammography, and which provides means for reducing acoustic disturbance.

In a rotating anode X-ray tube, a beam of electrons is directed through a vacuum, across very high voltage, from a cathode to a focal spot position on an anode. X-rays are produced as electrons strike the anode, comprising a refractory metal track, such as tungsten, molybdenum or rhodium, which is rotated at high speed. However, the conversion efficiency of X-ray tubes is quite low, typically less than 1% of the total power input. The remainder, in excess of 99% of the input electron beam power, is converted to thermal energy or heat. Accordingly, heat removal, or other effective procedure for managing heat, tends to be a major concern in the design and operation of an X-ray tube. Frequently, fans or the like are employed to circulate air to cool the tube.

In an X-ray imaging system designed for mammography, the patient is usually positioned so that her ears are very close to the X-ray tube, that is, within two or three centimeters. Typically, two significant sources of noise are located proximate to the tube. One source is the bearings contained within the tube casing, to support the rotary anode. The bearings produce an unpleasant high frequency noise as the anode rotates during X-ray generation. The other noise source is an arrangement of fans, which are typically located in a housing which also contains the tube, the fans being operated to circulate a stream of cooling air around the tube. Noise generated by both sources tends to be very disturbing to a mammography patient.

In the past, efforts have been made to reduce noise levels by surrounding the X-ray tube and the fans with sound absorbing material. However, materials commonly used for this purpose also tend to be thermally insulating. Thus, this approach to solving the noise problem prevents dissipation of heat away from the tube, so that the temperature of the tube may be quickly driven above the tube temperature limit.

SUMMARY OF THE INVENTION

The invention is directed to passive heat transfer apparatus for an X-ray imaging system provided with a rotating anode X-ray tube, wherein the heat transfer apparatus is disposed to rapidly conduct heat away from the tube and dissipate it into the surrounding environment. The apparatus may also be adapted to provide acoustic damping, or to reduce noise levels, and is particularly well suited for use in connection with X-ray equipment designed for mammography applications. However, the invention is by no means limited thereto. The invention generally comprises a thermally conductive plate or other support member, which is located in an X-ray tube housing in spaced apart relationship with the casing of the X-ray tube, also located in the housing. The invention further comprises an elongated heat transfer device having a first end which is proximate to the tube casing and a second end which is proximate to the support plate. A quantity of selected working fluid is sealably contained in the heat transfer device, the working fluid being disposed for bi-directional movement along the device to transfer heat from the first end of the transfer device to the second end thereof. Thus, the heat transfer device is passive and comprises a convective device, that is, employs fluid to move heat along its length. A heat dissipation device is provided to extend through the housing proximate to the support plate, for transferring heat from the support plate to air external to and surrounding the housing.

In a preferred embodiment of the invention, the heat transfer device comprises a conduit segment of selected length, the conduit segment having an inner wall in adjacent relationship with a sealed interior space. A selected porous material is attached to the inner wall and configured to define a passage through the sealed interior space that extends along the length of the conduit segment, the porous material being selected in relation to the working fluid so that the fluid, when in liquid form, is disposed for movement through the porous material by means of capillary action. When the first end of the transfer device is at a selectively higher temperature than the second end, the fluid proximate to the first end is vaporized into gaseous form, moved along the passage by means of convection to the second end, and then condensed into liquid form. Preferably, a layer of sound absorbing material is placed around the X-ray tube within the housing, to serve as a barrier to noise generated by anode rotation within the tube. Preferably also, the heat dissipation device comprises a number of cooling fins which are thermally joined to the support plate, and extend through the wall of the housing into the surrounding air or environment.

DETAILED DESCRIPTION OF THE PREFERRED EMBODIMENT

Figure 1:
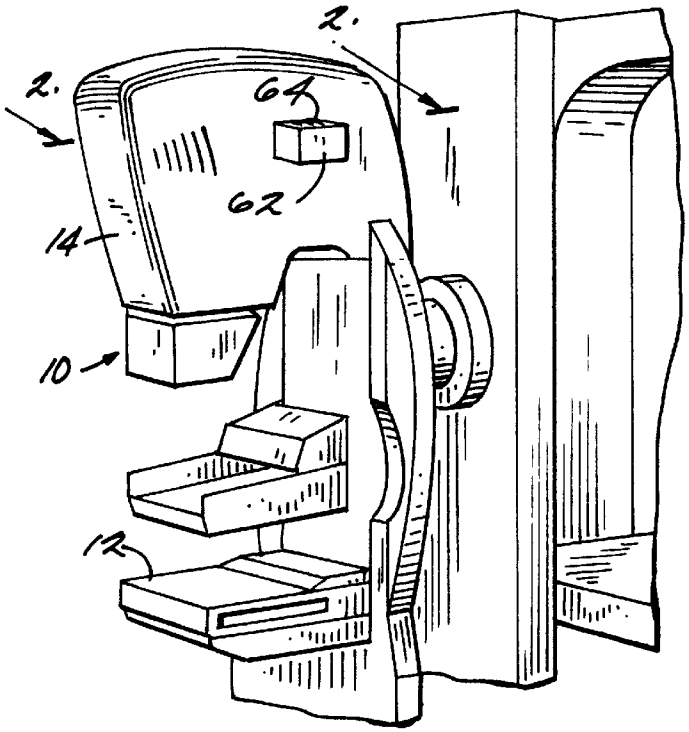
FIG. 1 is a perspective view showing an X-ray imaging system provided with an embodiment of the invention.

Referring to FIG. 1, there is shown an X-ray imaging system 10 of a type which is commonly used for mammography. In operation, a female patient (not shown) is positioned to stand close to system 10, so that her breast is placed upon support 12 for imaging. In such position, the patient's head and ears are adjacent to housing 14 of system 10, which contains an X-ray tube for producing X-rays required for imaging. Thus, it is highly desirable to limit, as much as possible, the level of noise emanating from housing 14. At the same time, means must be provided for effective heat removal, as described above.

Figure 2:
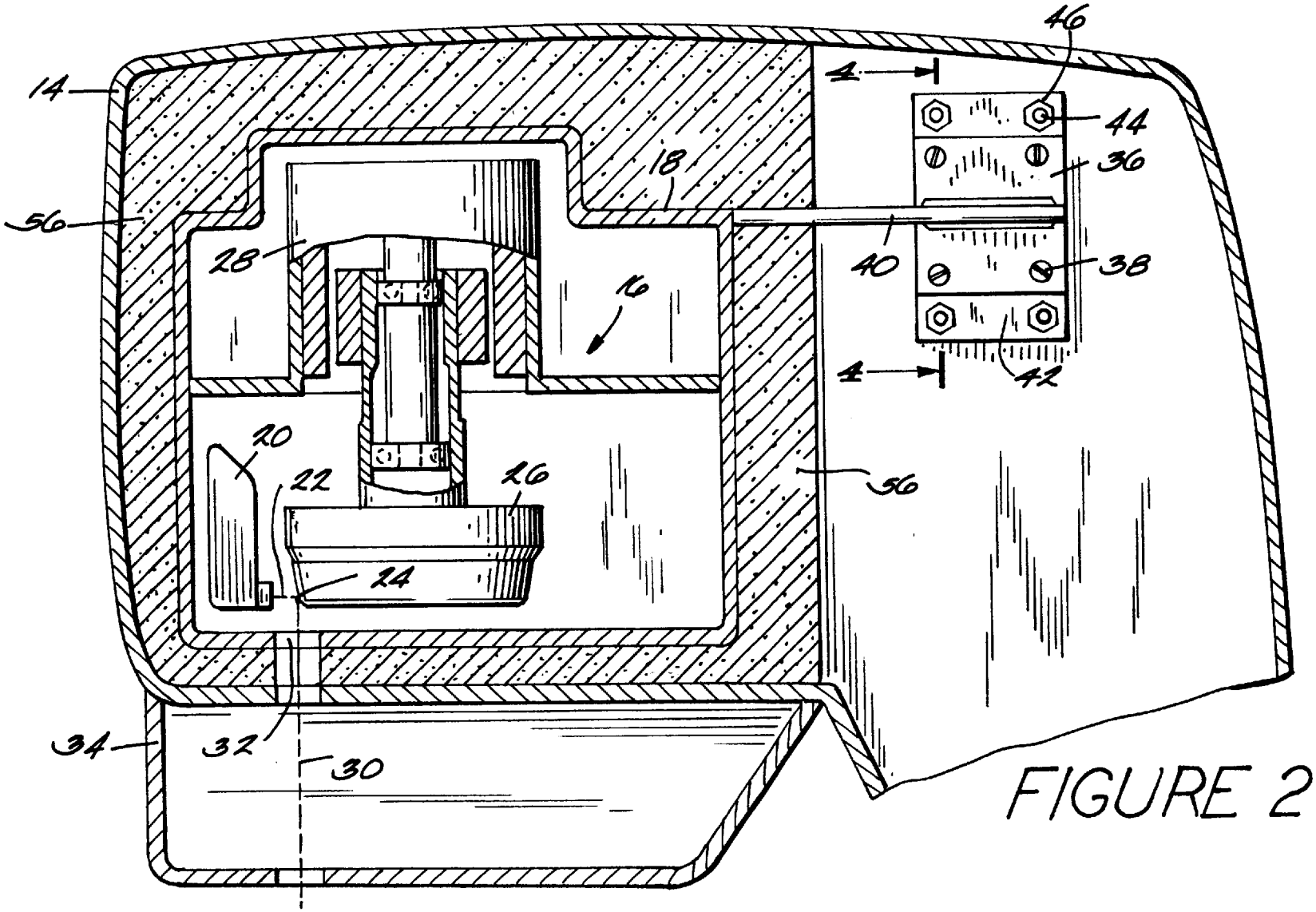
FIG. 2 is a sectional view, taken along lines 2—2 of FIG. 1, which shows an embodiment of the invention.

Referring to FIG. 2, there is shown an X-ray tube 16 within housing 14. In accordance with conventional practice, tube 16 generally includes a metal casing 18 which supports other X-ray tube components including a cathode 20, and which also provides a protective vacuum enclosure therefor. Cathode 20 directs a high energy beam of electrons 22 onto a target track 24 of an anode 26, which consists of a refractory metal disk and is continually rotated by means of a conventional mounting and drive mechanism 28. Target track 24 has an annular or ring-shape configuration and typcially comprises a tungsten, molybdenum or rhodium based alloy integrally bonded to the anode disk 26. As anode 26 rotates, the electron beam from cathode 20 impinges upon a continually changing portion of target track 24 to generate X-rays, at a focal spot position. A beam of X-rays 30 generated thereby is projected from the anode focal spot through an X-ray transmissive window 32 provided in the side of housing 18, and is further projected through a plastic cover 34 positioned below housing 14. In order to produce X-rays as described above, there must be a potential difference on the order of 25–140 kilovolts between cathode 20 and anode 26.

In accordance with the invention, it has been recognized that it would be highly advantageous to quietly, passively and efficiently remove heat, generated by production of X-rays, from regions proximate to tube casing 18. Thus, FIG. 2 further shows an elongated heat transfer device 40, for conducting heat by convection, extending from tube casing 18 to a support plate 36 spaced apart from the tube. The left end of device 40, as viewed in FIG. 2, is fixably joined to casing 18, such as by brazing, and the right end is fixably joined to and supported by plate 36. Plate 36 is formed of copper or other thermally conductive material, and is joined by screws 38 or the like to another plate 42, likewise formed of copper or other thermally conductive material. Plate 42 is fixably attached to an inner side or wall of housing 14 by means of bolts 44 and complementary nuts 46.

Figure 3:
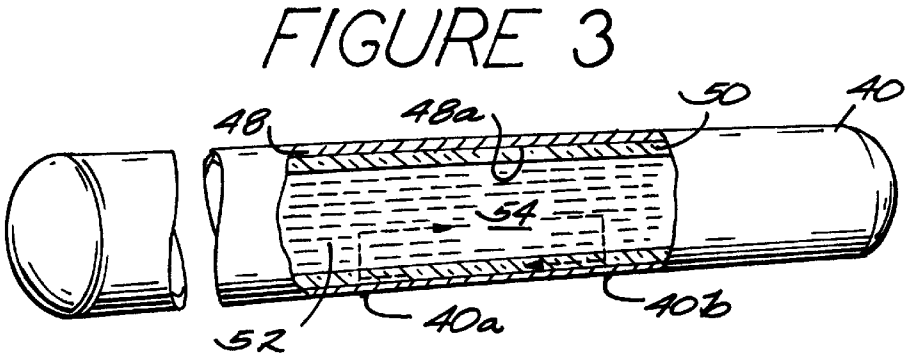
FIG. 3 is a perspective view having a section broken away showing a heat transfer device which may be used in the embodiment of FIG. 2.

Referring to FIG. 3, there is shown a heat transfer device which may usefully be employed as transfer device 40. The device 40 of FIG. 3 comprises a length of copper tubing or conduit 48, which is tightly closed or sealed at its ends to form a vacuum tight vessel. The vacuum tight vessel provided by conduit 48 is evacuated and partially filled with a working fluid 52, such as water, and is usefully of circular cross section. FIG. 3 further shows a porous metal wicking structure 50, which is joined to the inner wall or surface 48*a* of copper conduit 48. Wicking structure 50 is usefully formed of a porous material, such as a material comprising small copper pellets or beads which are sintered together. Wick structure 50 is configured to surround or define a passage 54 which extends along the length of transfer device 40.

By providing a heat transfer device 40 with the construction shown in FIG. 3, such device is enabled to transfer heat by respective evaporation and condensation of working fluid 52. More particularly, if point 40*a* along device 40 is at a higher temperature than a location 40*b* spaced apart therefrom, heat is inputted through conduit 48 into the interior thereof, proximate to location 40*a*. As a result, the fluid 52 is vaporized in passage 54 proximate to location 40*a*. This creates a pressure gradient in passage 54, between a region proximate to location 40*a* and a cooler region proximate to location 40*b*. This pressure gradient forces the vaporized fluid to flow along passage 54 to the cooler region, where it condenses to a liquid and gives up its latent heat of vaporization. The working fluid 52, now in liquid form, then flows in the opposite direction along device 40, back toward location 40*a,* through the porous wick structure 50. Such fluid motion is caused by capillary action in the wick structure, or by gravity if device 40 is oriented to decline downwardly from location 40*b* to location 40*a*. Usefully, a heat transfer device 40 comprises a device which is similar to a product sold by Thermacore Inc. and referred to commercially thereby as a heat pipe. Devices of such type may have an effective thermal conductivity which exceeds the thermal conductivity of copper by more than $10^3$. Moreover, such devices are silent and totally passive, that is, they do not require power sources for their operation, in contrast to fans or like cooling devices.

By incorporating heat transfer device 40 in the arrangement shown in FIG. 2, substantial quantities of heat can be conducted from metal tube casing 18 to support plate 36, quietly and with a high degree of efficiency. Thus, the heat is removed from regions proximate to tube 16. Accordingly, the tube can be surrounded with sound absorbing material 56, to absorb noise produced by the bearings of X-ray tube mounting and drive mechanism 28, which support annode 26 for rotation. Material 56 usefully comprises a foam material or a foam material with a backing of lead or other mass material, which is commercially available. It is anticipated that use of such material could reduce noise levels by as much as 10 dBA, relative to comparable mammography systems of the prior art. The sound absorbing material 56, notwithstanding its thermal insulating effects, would not trap heat around tube 16, since heat is removed by device 40 as stated above.

As a further benefit, the arrangement shown in FIG. 2 eliminates the need to use forced convection cooling on the outer surface of tube casing 18, and therefore eliminates any requirement for fans in mammography imaging system 10. Thus, a second source of noise is completely removed from the system. Moreover, since the system cooling is totally passive, failure modes associated with fans are also eliminated.

Figure 4:
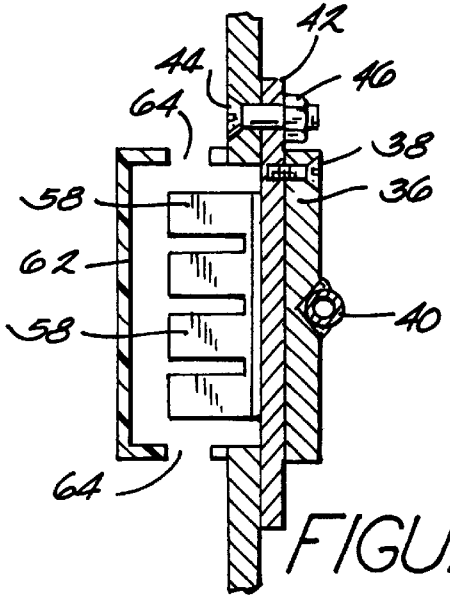
FIG. 4 is a sectional view taken along lines 4—4 of FIG. 2.

Referring to FIG. 4, there are shown cooling fins 58 fixably joined to the side of plate 42 which is opposite the plate 36, the fins extending through the wall of housing 14 into the air surrounding and external to imaging system 10. Fins 58 are formed of copper or other thermally conductive material. By providing fins 58, heat transferred from X-ray tube 16 by device 40 will flow through plates 36 and 42 to the fins 58, and then be dissipated thereby into the surrounding air by free convection. A protective plastic cover 62, provided with vents 64, is usefully placed over fins 58. A thermal compound could also be added between plates 36 and 42 to enhance heat transfer therebetween.

In another embodiment of the invention a single support plate could be substituted for the two plates 36 and 42, with both heat transfer device 40 and fins 58 being fixed to the single plate. However, the configuration shown in FIG. 4 is considered to be advantageous, particularly in connection with tube replacement. By fixably joining casing 18, transfer device 40 and support plate 36 together as a unit, the unit can be detached from the wall of housing 14 in the event tube replacement is required, merely by removal of screws 38. Plate 42 and fins 58 would remain fixably attached to the housing 14 of mammography system 10.

In another embodiment of the invention, an arrangement employing transfer device 40 and insulation material 56 as described above could be employed to maintain tube-generated noise at the level of currently used systems, while the tube anode was operated at a significantly higher rotational speed.

If free convection cooling of the fins is inadequate, the fins could also be moved to the upper back surface of the covers and a fan used to cool the fins. The fan would be located away from the patient's ear, hence minimizing noise heard by the patient.

Figures 5, 6:
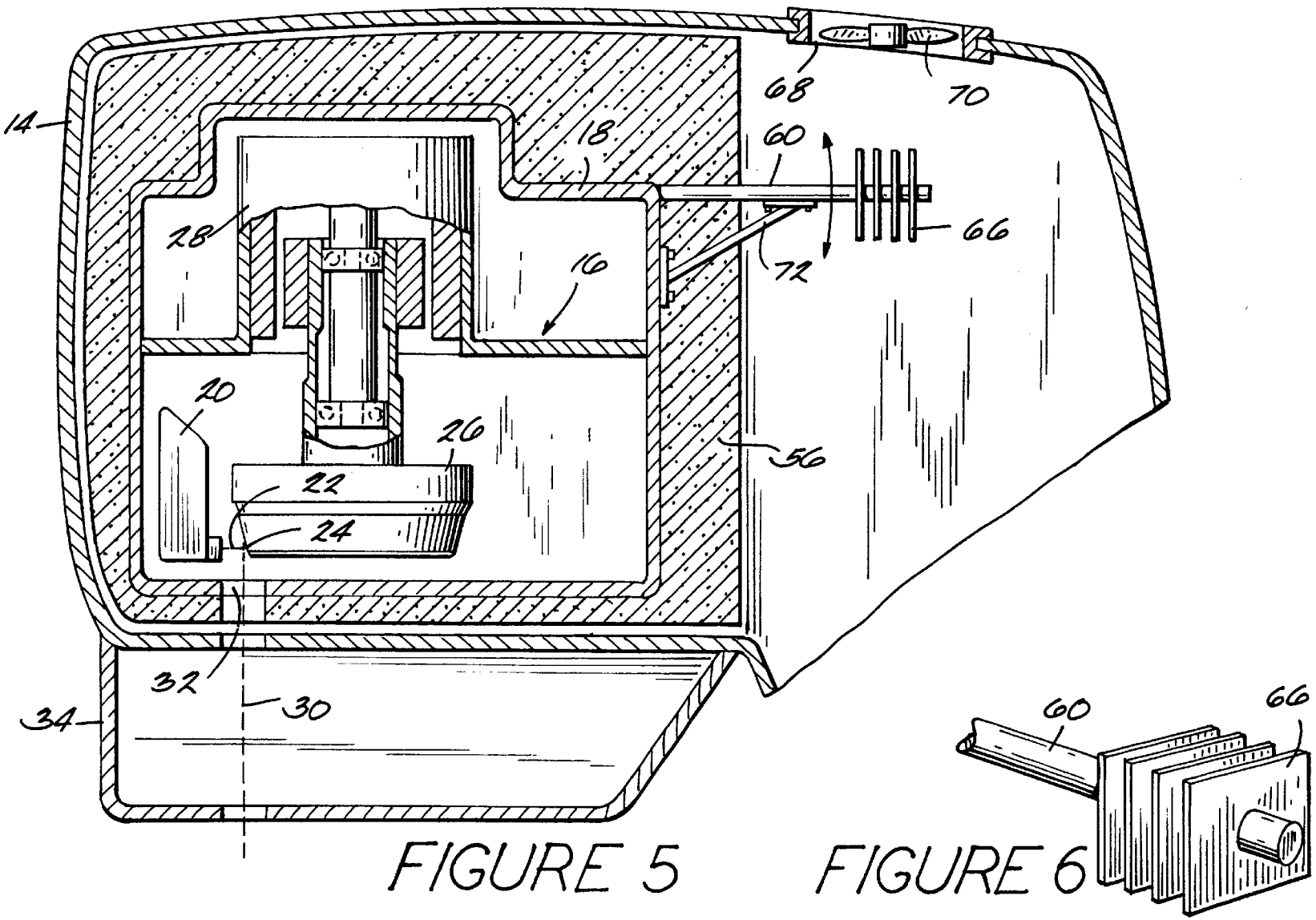
FIG. 5 is a cross-sectional view taken along lines 2—2 of FIG. 1, which shows another embodiment of the present invention.
FIG. 6 is a perspective view of a heat transfer device according to the embodiment of FIG. 5.

In certain mammography tube designs, the tube 16 is mounted for rotatable or pivotal movement, relative to housing 14, through a small angle with respect to an axis through the focal spot and orthogonal to the plane of the view shown in FIG. 5. By means of such movement, the projected X-ray beam 30 can be selectively varied to meet different imaging beam requirements. It will be apparent that the embodiment shown in FIG. 2, wherein one end of transfer device 40 is fixed to tube 16 and the opposing end is fixed to housing 14 by means of plate 36, could not be used with a tube that had to be movable with respect to the housing. Accordingly, an alternative embodiment is provided, as shown by FIG. 5, which includes a heat transfer device 60 which is similar or identical to device 40 described above. The left end of device 60, as viewed in FIG. 5, is brazed or otherwise fixably joined to tube casing 18, also in like manner with device 40. Thus, heat generated by tube 16 is conducted away by device 60, from the left end to the right end thereof. However, the right end of device 60 remains unconstrained, so that it can move freely or float within housing 14. Thus, heat transfer device 60 is able to rotate or pivot together with tube 16, as shown by the arrow in FIG. 5.

Referring further to FIG. 5, there is shown a set of fins 66 mounted along device 60, toward the rightward end thereof, for dissipating heat from tube 16 into a region of housing 14 which is spaced apart from the tube. As with the embodiment of FIG. 2, the region is separated from tube 16 by a layer of sound absorbing material 56. A vent 68 is provided through housing 14, to enable the heat from fins 66 to readily flow out from the housing. Such heat flow may be assisted by placing a fan 70 proximate to the vent 68. The fan 70 will be located much farther from the ears of an imaging subject than the fan of a conventional mammography arrangement, as described above, and will thus be much less disturbing. FIG. 5 further shows a bracket 72 provided to support fins 66 and the rightward end of heat transfer device 60, relative to the tube casing 18.

Referring to FIG. 6, there is shown heat transfer device 60 and fins 66 joined thereto in further detail.

Obviously, many other modifications and variations of the present invention are possible in light of the above teachings. It is therefore to be understood that within the scope of the disclosed concept, the invention may be practiced otherwise than as has been specifically described.

What is claimed is:

1. In an X-ray imaging system provided with a rotary anode x-ray tube enclosed within a thermally conductive tube casing, wherein said tube and said tube casing are contained within a housing, apparatus for transferring heat away from regions proximate to said X-ray tube comprising:

selected heat dissipating structure located in said housing in spaced apart relationship with said tube casing;

an elongated heat transfer device having a first end proximate to said tube and a second end proximate to said heat dissipating structure;

means for supporting said heat transfer device within said housing to position said first end of said heat transfer device proximate to said tube, and to position said second end thereof proximate to a wall of said housing in spaced apart relationship with said tube casing; and a quality of selected working fluid sealably contained in said heat transfer device, said working fluid disposed for bi-directional movement along said transfer to device to conduct heat from said first end thereof to said second end thereof.

2. The apparatus of claim 1, wherein said heat transfer device comprises:

a conduit segment of selected length, said conduit segment having an inner wall in adjacent relationship with a sealed interior space; and selected porous material attached to said inner wall and configured to define a passage through said sealed interior space that extends along the length of said conduit segment, said porous material being selected in relation to said working fluid so that said fluid, when in liquid form, is disposed for movement through said porous material by means of capillary action.

3. The apparatus of claim 2 wherein:

when said first end of said transfer device is at a selectively higher temperature than said second end, fluid proximate to said first end is vaporized into gaseous form, moved along said passage by means of convection to said second end, and then condensed into liquid form.

4. The apparatus of claim 1 wherein:

a layer of sound absorbing material is placed to surround said X-ray tube within said housing.

5. The apparatus of claim 4 wherein:

said sound absorbing material comprises a selected foam material.

6. The apparatus of claim 4 wherein said heat dissipating structure comprises:

a thermally conductive support member located in said housing in spaced apart relationship with said tube casing; and a cooling device extending through said housing proximate to said support member for dissipating heat from said support member into the air surrounding said housing.

7. The apparatus of claim 6 wherein:

said cooling device comprises a first thermally conductive plate fixably joined to a wall of said housing;

said support member comprises a second thermally conductive plate detachably joined to said housing wall in contacting relationship with said first plate; and said first and second ends of said heat transfer device are fixably joined to said tube casing and to said second thermally conductive plate, respectively.

8. The apparatus of claim 7 wherein:

said cooling device further comprises a number of cooling fins joined to said first thermally conductive plate and attached to said housing wall on the side thereof opposing said first plate.

9. The apparatus of claim 7 wherein:

said first and second plates are formed of copper.

10. The apparatus of claim 6 wherein:

said support member comprises a single thermally conductive plate fixably joined to a wall of said housing;

said first and second ends of said heat transfer device are fixably joined to said tube casing and to said thermally conductive plate, respectively; and said cooling device comprises a number of cooling fins joined to said thermally conductive plate on the side thereof opposite said heat transfer device.

11. The apparatus of claim 3 wherein:

said first end of said heat transfer device is fixably joined to said tube casing, and said transfer device is disposed to move with said tube; and said heat dissipating structure comprises fins joined to said second end of said transfer device to dissipate heat conducted therealong from said first end thereof to said second end.

12. In an X-ray imaging system provided with a rotary anode X-ray tube enclosed within a thermally conductive tube casing, wherein said tube and said tube casing are contained within a housing, apparatus for transferring heat away from regions proximate to said X-ray tube comprising:

an elongated heat transfer device having first and second ends;

means for supporting said heat transfer device within said housing to position said first end of said heat transfer device proximate to said tube, and to position said second end thereof proximate to a wall of said housing in spaced apart relationship with said tube casing;

a quantity of selected working fluid sealably contained in said heat transfer device, said working fluid disposed for bi-directional movement along said transfer device to conduct heat from said first end thereof to said second end thereof; and cooling means proximate to said second end of said heat transfer device for dissipating heat conducted along said heat transfer device into the air surrounding said housing.

13. The apparatus of claim 12, wherein said heat transfer device comprises:

a conduit segment of selected length, said conduit segment having an inner wall in adjacent relationship with a sealed interior space; and selected porous material attached to said inner wall and configured to define a passage through said sealed interior space that extends along the length of said conduit segment, said porous material being selected in relation to said working fluid so that said fluid, when in liquid form, is disposed for movement through said porous material by means of capillary action.

14. The apparatus of claim 13 wherein:

when said first end of said transfer device is at a selectively higher temperature than said second end, fluid proximate to said first end is vaporized into gaseous form, moved along said passage by means of convection to said second end, and then condensed into liquid form.

15. The apparatus of claim 12 wherein:

a layer of sound absorbing material is placed to surround said X-ray tube within said housing.

16. The apparatus of claim 15 wherein:

said sound absorbing material comprises a selected foam material provided with a selected backing.

17. The apparatus of claim 12 wherein:

said supporting means comprises a first thermally conductive plate fixably joined to a wall of said housing, and a second thermally conductive plate detachably joined to said first plate in contacting relationship therewith; and said first and second ends of said heat transfer device are fixably joined to said tube casing and to said second thermally conductive plate, respectively.

18. The apparatus of claim 17 wherein:

said cooling means extends through said housing and comprises a number of cooling fins joined to said first thermally conductive plate.

19. The apparatus of claim 18 wherein:

said first and second plates and said fins are respectively formed of copper.

20. The apparatus of claim 12 wherein:

said supporting means comprises a bracket joining said transfer device to said tube for movement therewith, said first end of said transfer device being in fixed contacting relationship with said tube casing; and said cooling means comprises a number of cooling fins joined to said second end of said transfer device.

21. The apparatus of claim 20 wherein:

said cooling means further comprises a fan spaced apart from said cooling fins for moving a stream of air through said fins and then through a vent provided in said housing wall.

* * * * *